US005929362A

United States Patent [19]

Oteyza

[11] Patent Number: 5,929,362

[45] Date of Patent: Jul. 27, 1999

[54] GUITAR WITH REMOVABLE FRETBOARD AND PICKUP SECTION POWERED BY A HEADPHONE AMPLIFIER

[76] Inventor: Julian Oteyza, 6236 N. 12th Rd., Arlington, Va. 22205

[21] Appl. No.: 09/055,625

[22] Filed: Apr. 6, 1998

[51] Int. Cl.[6] ..... G10D 3/00; G10H 3/00

[52] U.S. Cl. ..... 84/743; 84/723; 84/293; 84/DIG. 3

[58] Field of Search ..... 84/723–728, 743, 84/290–291, 293, DIG. 3

[56] References Cited

U.S. PATENT DOCUMENTS

| | | | |
|---|---|---|---|
| 3,657,462 | 4/1972 | Robinson | 84/1.16 |
| 4,254,683 | 3/1981 | Nulman | 84/1.16 |
| 4,295,403 | 10/1981 | Harris | 84/293 |
| 5,315,910 | 5/1994 | Soupios | 84/453 |
| 5,744,744 | 4/1998 | Wakuda | 84/650 |

FOREIGN PATENT DOCUMENTS

| | | |
|---|---|---|
| 2831666 | 2/1980 | Germany . |
| 2045993 | 11/1980 | United Kingdom . |

*Primary Examiner*—William M. Shoop, Jr.
*Assistant Examiner*—Marlon T. Fletcher
*Attorney, Agent, or Firm*—Robert G. Lev

[57] ABSTRACT

A guitar has a removable neck section including fretboard, electronic pick up system with a built in headphone amplifier system for private listening. The detached main body also has an amplifier with a built in loudspeaker which can be activated when the neck section is attached, or used as a stand alone amplifier for a microphone, tape player, radio, cd player, or other electronic instrument. The instrument can also be played as a standard electronic guitar by plugging it into an external amplifier. The built in sound system enables the performer to move around the room without being constrained by a cord to external amplifiers or speakers. Also, power requirements can be reduced since the speaker moved with the guitar and is not being left in a disadvantageous position.

13 Claims, 5 Drawing Sheets

FIG. 1
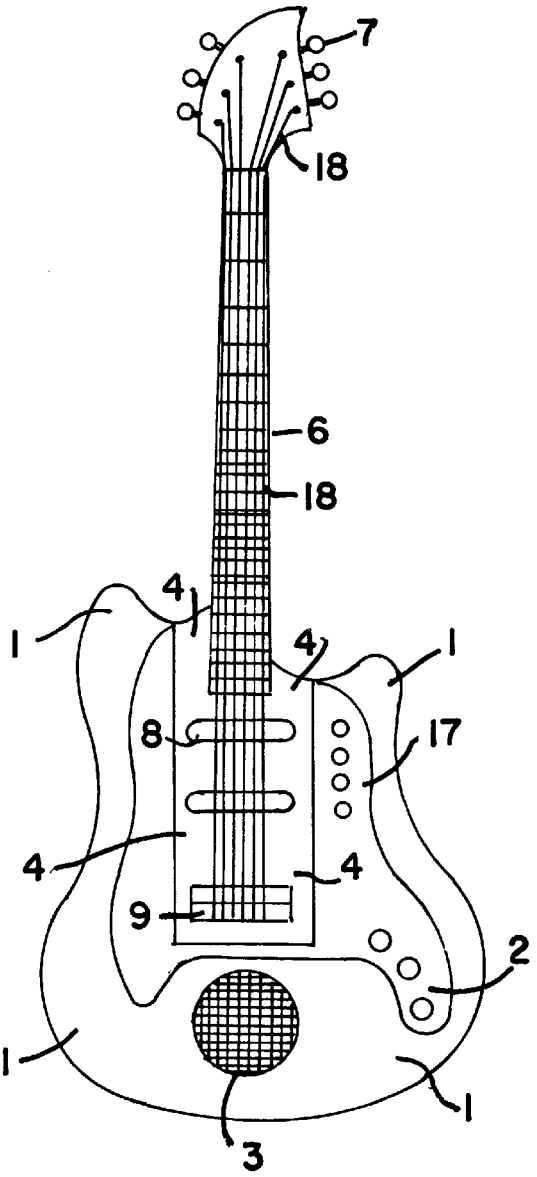
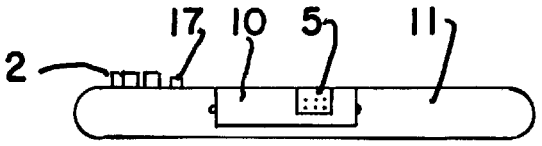
FIG. 2

FIG. 3
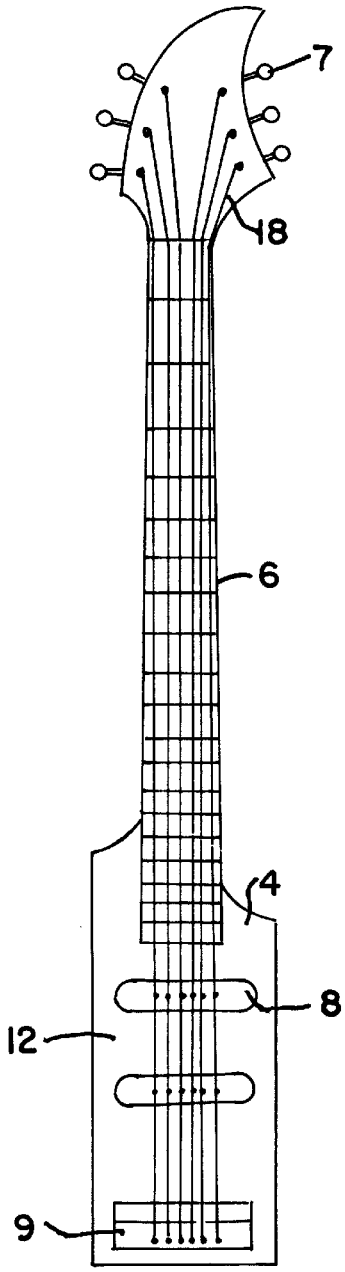
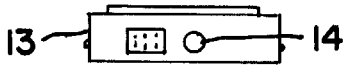
FIG. 4

GUITAR WITH REMOVABLE FRETBOARD AND PICKUP SECTION POWERED BY A HEADPHONE AMPLIFIER

FIELD OF THE INVENTION

This invention relates to stringed musical instruments such as guitars. In particular, the present invention is directed to a system wherein an electric guitar fretboard or neck section is arranged to be detachable from a standard electric guitar body without altering the guitar, and the guitar fretboard can be operated independently of the electric guitar body.

BACKGROUND OF THE INVENTION AND DESCRIPTION OF PRIOR ART

Typically a stringed instrument consists of a neck section and a main body assembly. The strings are supported at one extreme end of the neck section by a head member attached to the neck assembly and at the other extreme end by a tailpiece attached to the main body. Thus the neck section and main body are structurally interdependent in supporting the strings. While musically this arrangement is acceptable, there is the limitation that a body selection once made is permanent insofar as a particular instrument concerned. With purely acoustical guitars this does not seem to be much of a detriment. However, with the evolution of electric guitars has occurred a demand for a wide range of body configurations has arisen there vary from structure having large cavities to those having small cavities, as well as to various sizes and shapes of guitar bodies. Thus a musician who a requires an instrument having different body configurations must purchase a plurality of different complete guitars.

A number of related arrangements have been provided in the conventional art to address this drawback. The first is disclosed in U.S. Pat. No. 3,657,462 to Robinson, describing a stringed musical instrument such as a guitar wherein the neck assembly is extended to include the bridge and tailpiece. The body of the instrument and neck assembly are detachable from each other. The end region of the neck assembly supports the tailpieces made in the form of a U. A cut out region at the rear of the body is adapted to receive and form a tongue and grove structural joint between the neck assembly and a body of the instrument.

U.S. Pat. No. 4,254,683 to Nulman discloses an electric stringed musical instrument formed of a body section adapted to detachably receive an interchangeable neck section. The body section mounts the electronic tone and volume controls and includes the electromagnetic pick up which is arranged in operative proximity to the next strings when the instrument is fully assembled arrangement. The body section is adapted to interchangeably receive neck sections of various string types and finger board widths. To accommodate this, the electromagnetic pick up is selectively moveable in the longitudinal and latitudinal directions to accommodate the particular string characteristics of an interchangeable neck section.

U.S. Pat. No. 4,295,403 to Harris discloses an attachment device for adjustably mounting the neck section to the main body of a stringed musical instrument, such as a banjo. The device has a pair of plates for attachment respectively to the neck and body of the banjo. A pivot point locates one plate with respect to the other, and a pair of adjustment screws interconnect the plates, cooperatively controlling the angle at which the neck extends away from the body. Elongated holes in one of the adapter plates receive the adjustment screws, permitting the neck to be rotated with respect to the body about the longitudinal axis of the neck. The device may include a brace bar extending across the body of the instrument to hold a tailpiece. A set screw posses tension in the adjustment screws to hold the plate in the desired relative positions.

U.S. Pat. No. 5,315,910 to Soupios discloses an external support system that connects an electronic guitar module such to a standard electrical guitar body or base by detachably anchoring a linear holding device to the body of the instrument. The holding device causes no alteration of the standard instrument, attaching to a posterior strap fastening anchor. An interior horn-shaped curvature provides a slidable locking mechanism which fastens the external module to the electronic guitar body.

German Patent No. 2831666 to Lohberg discloses an electric guitar arranged in modular form to allow a range of string bridges to be fitted to the main body of the guitar, which has a slot that provides a location for the string bridge. The bridge carries two sound pick ups. The tone and volume controls are mounted on the main body of the guitar. When the bridge is inserted into the locating slot, it is secured by a clamping bolt on the underside of the guitar body.

U.K. Patent No. GB2045993A to Townshend discloses an electric guitar with a body portion and a neck portion which may be readily engaged and disengaged from the body portion. The neck portion is a metal casting with a wooden fretboard that carries strings, a head with tuning devices, a bridge with a tremolo device and electromagnetic pick ups. The advantage of this arrangement is that the strings may be pre-tuned before the neck is inserted into the body. The body portion carries all the usual pick up controls and consists of a metal core with a plastic cover. The space between the core and the cover is filled with polyurethane foam. The body also has connectors which are arranged to connect the pick ups to the controls when the neck is engaged the body portion. The neck is held to the body portion with a releaseable locking device.

None of the conventional art discloses a system in which a removable guitar neck section with electronic pick up can be played separately from the guitar body in order to carry out tuning, or private practice. Further, none of the examples of conventional art disclose a system which allows an electric guitar to be moved in a manner totally independently of the position of the guitar sound system amplifiers and loud speakers.

SUMMARY OF THE INVENTION

Accordingly, it is one object of the present invention to provide a guitar with a removable neck section with a fretboard that is capable of being tuned independent of the guitar body.

It is another object of the present invention to provide a guitar having a removable neck section including fretboard that admits to being played separate from the guitar body.

It is a further object of the present invention to provide a guitar with a removable neck section including fretboard which provides full sound separate of the guitar body.

It is an additional object of the present invention to provide a guitar with a removable neck section fretboard that permits private tuning and playing of the fretboard including appreciable sound radiating into the area surrounding the guitar.

It is still another object of the present invention to provide a guitar with a loud speaker that moves with the guitar body.

It is yet another object of the present invention to provide a fully portable electric guitar system in a unitary body.

It is yet an additional object of the present invention to provide an electric string instrument formed of a main body and neck section which are readily assembled to form a unitary instrument, and disassembled without the requirement of any tools.

It is again another object of the present invention to provide an electric string instrument having a main body section adapted to interchangeably mount any one of a plurality of fretboard sections having various string configurations.

It is still a further object of the present invention to provide a fully independent and detachable alternative to the instruments that employ integral fretboard rail systems which can gradually pull apart from a guitar body through constant use.

These and other goals and objects of the present invention are achieved by a string board instrument having a main body and a removable neck section. The removable neck section includes a fretboard with strings and a bridge. The neck section also includes a pick up device for detecting vibration of the strings and converting vibrations to electronic signals, and a headphone amplifier arranged to amplify the electrical signals to be played into the headphone attached to a amplifier.

Another embodiment of the present invention is manifested by a string board instrument having a main body and a removable neck section. The neck section includes a fretboard with strings and a bridge. When the fretboard is assembled with the main body, a pick up device in the main body detects the vibration of the strings. An amplifier fully contained within the main body amplifies the vibration of the strings and feeds this signal to a speaker also contained within the main body.

BRIEF DESCRIPTION OF THE DRAWINGS

FIG. 1 is a front view of the instrument with the removable neck section attached to the main body.

FIG. 2 is a top view of the main body without the neck section, depicting the channel where the removable neck section slides into the main body.

FIG. 3 is a top view of a neck section removed from the main body, depicting the tuning pegs, the pickups, bridge, tailpiece and headphone amplifier.

FIG. 4 an end view of the detached neck section, depicting a nine-pin connector and the strap holder.

DESCRIPTION OF THE PREFERRED EMBODIMENT

The present invention is preferably applied to electric guitars such as that depicted in FIG. 1. This embodiment of the present invention is arranged in two separable pieces, the main body 1 and a neck section 4. The main body and the neck section can be used together as a single, self-contained electric guitar, in a manner similar to that used for conventional electric guitars. In the alternative, the neck section can be entirely detached and its fretboard 6 played by itself for purposes of tuning the strings 18, or private listening as described infra.

Figure 5:
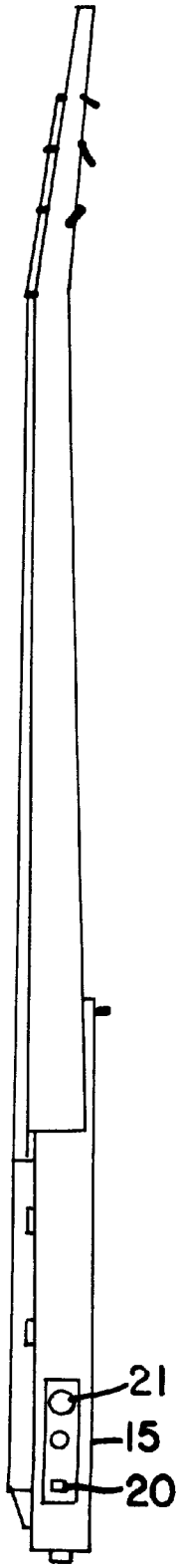
FIG. 5 is a side view of the removable neck section, depicting the headphone connector and the strap holder.
Figure 6:
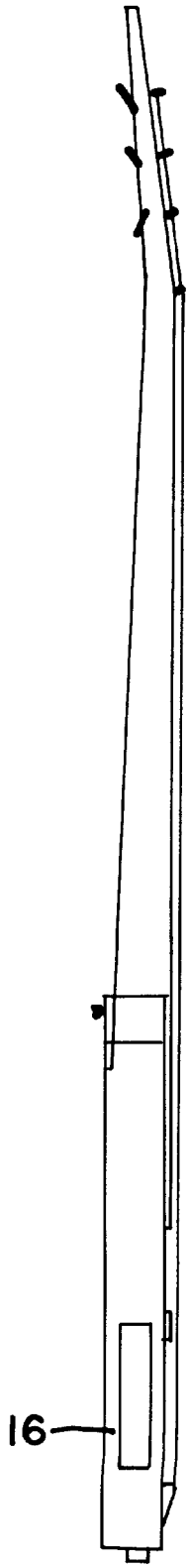
FIG. 6 is another side view of the removable neck section, depicting the battery compartment which holds the battery for the headphone amplifier.
Figure 7:
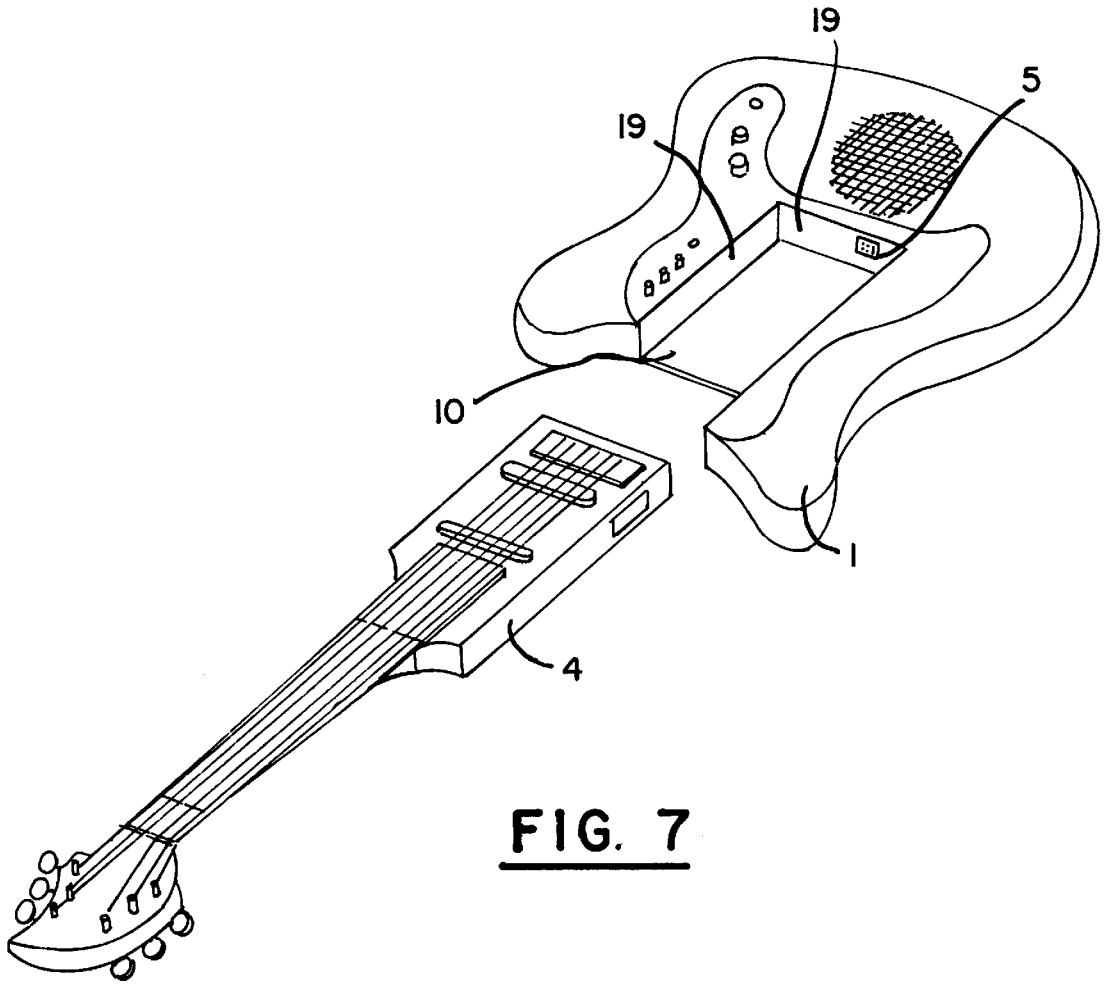
FIG. 7 is a perspective view of the complete instrument, depicting how the neck board and main body interface with each other.

The neck section 4 is designed to slip into a cavity 10 of the main body 1 as indicated in FIG. 7. The neck section is held within the cavity 10 by the cavity walls 19 so that the neck section is firmly held on 4 (out of a total of 6) surfaces. Additional mechanical holding power is provided by the interface of connector 13 on the neck section (as depicted in FIGS. 4, 5 and 6) and connector 5 on the main body (as depicted in FIGS. 2 and 7).

The neck section 4 is depicted without attachment to the main body 1 in FIG. 3. Six tuning pegs 7 are used on strings 18 which cover fretboard 6, running between the pegs and the bridge 9. An electronic pick-up 8 is used to convert the sound waves caused by string vibration into electrical signals. This is done using well known circuitry, and so requires no further elaboration for purposes of the present invention. The electronic signals from the sound vibrations of the guitar strings can be fed to devices external to the neck section by means of connector 13. This is designed to interface with connector 5 on the main body 1 to allow the two sections to operate as a single unit.

The neck section 4 can be played by itself, supported in the same manner as one would play a full sized guitar. This is facilitated by strap connection 14 arranged next to connector 13, as depicted in FIG. 4.

In FIG. 3, the drawing designation labeled 12 denotes the portion of neck section 4 that contains electronic circuitry including the amplifier, battery and headphone connection. FIG. 5 depicts the location of the pick-up on/off switch 20, the volume control 15 and the headphone jack 21. The battery 16 is depicted in FIG. 6, and is arranged so that batteries can easily be inserted or removed when the neck section 4 is separated from the main body 1.

Figure 8:
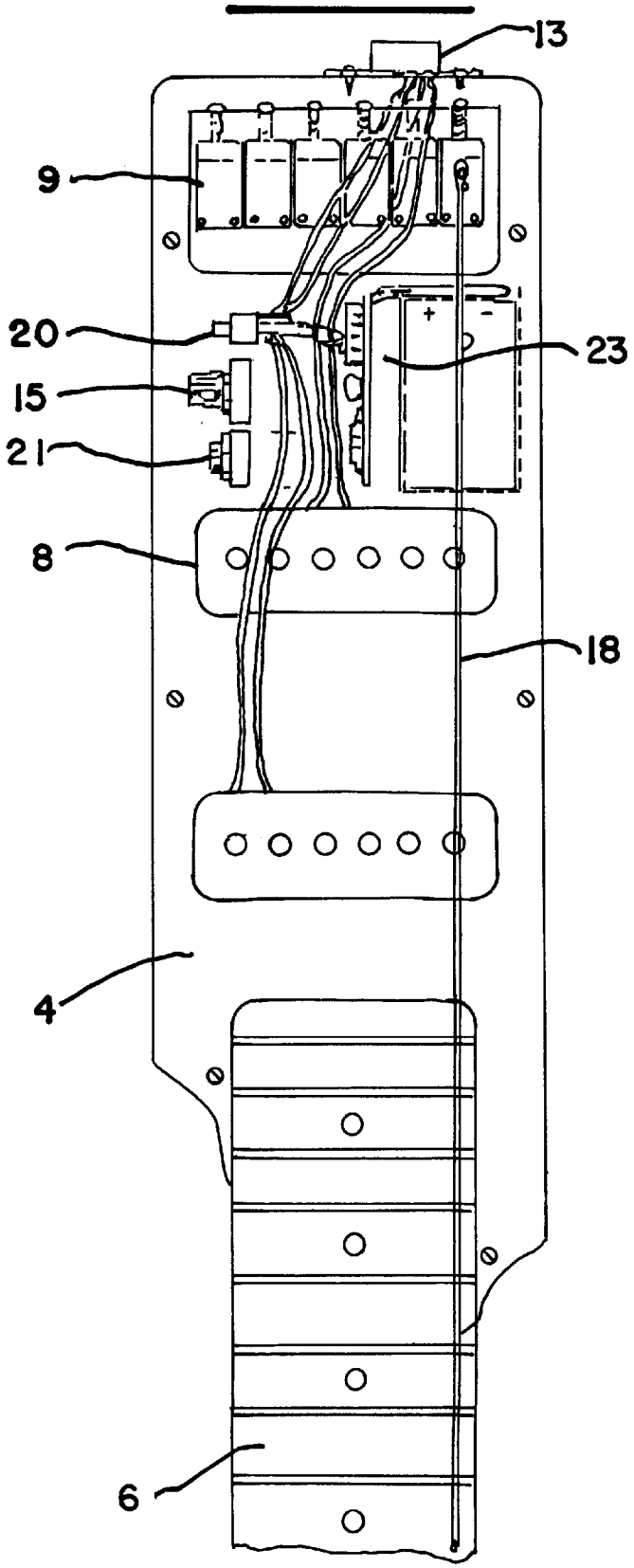
FIG. 8 is a detailed top view of the neck section, depicting the electrical pick up system.

Electronic pick-up 8 is connected to headphone amplifier 23 (FIG. 8) so that electronic signals generated by pick-up 8 (from the vibration of string 18) are amplified, and can be privately heard by a listener using a headset connected to headphone jack 21. The volume of the sound received by a headphone through the headphone jack is adjustable by volume control 15, preferably affected by a potentiometer.

The pick-up on/off switch 20 is used to turn on the amplifier 23 when using the neck section 4 separately from the main body 1 of the guitar. The pick-up switch on/off switch can be a manual switch so that it must be activated in order to use the neck section by itself for tuning or playing. On the other hand, the pick-up on/off switch can be automatic so that the headphone amplifier 23 is automatically deactivated when connector 13 interfaces with connector 5 on the main body 1. Under such circumstances, the headphone amplifier should be deactivated and the output of pick-up 8 sent directly to the amplifier (not shown) in the main body 1 of the guitar.

In another variation, the pick-up on/off switch 20 is automatically activated when the neck section 4 is detached from the main body 1, and deactivated when the neck section is connected with the main body. Any number of variations can be used in order to facilitate both separate operation of the neck section as well as the operation of the neck section in conjunction with the main body of the guitar. Such electrical connections are well known to those skilled in the art and need not be elaborated upon for purposes of the present invention.

The key aspect of the present invention is that the neck section 4 can be used by itself, separate from the main body 1 of the guitar by virtue of the independent headphone amplifier 23. Thus, the strings 8 on fretboard 6 can be tuned separately and played separately at a low power level since only sufficient power for a headset is required. The use of the headset also facilitates private playing and tuning which is unlikely to disturb others in the vicinity of the individual playing the neck section.

The main body 1 of the guitar (as depicted in FIG. 1) includes a main guitar amplifier (not shown) contained within the body of the guitar. A loud speaker 3 is connected to the main amplifier to radiate amplified guitar signals wherever the guitar is located. This allows the guitar player to project sound where desired without recourse to moving the separate speakers that are normally attached to the guitar by way of a cable. Thus, the guitar of the present invention permits flexibility not found in conventional electric guitar systems.

Should the use of a large amplifier system with large external speakers be desired, a cable can be connected to connector 2 so that the guitar of the present invention can feed a conventional electric guitar application system.

The internal amplifier of the main body 1 is controlled by the controls 17 arranged on the front surface of the guitar in a standard manner (as depicted in FIG. 1). The guitar can be powered using a power extension cord in a conventional manner, or the guitar can be powered using batteries (not shown). Such batteries will fit into the body of the guitar in a manner similar to that shown for the neck section 4, as depicted in FIG. 6.

In an alternative embodiment, the controls 17 on the main body of the guitar 1 can be wired so as to activate or deactivate the headphone amplifier 23 contained in the neck section. The electrical connections between the main body and the neck section are facilitated by the interface of nine pin connectors 5 (on the main body) and 13 (on the neck section). The wiring schemes for the various arrangements that are possible for controlling the amplifier and the main body and the headphone amplifier and the neck section are well known to those skilled in the art of electric guitar controls. Consequently, further elaboration is not needed for purposes of the present invention.

While a number of embodiments and variations have been provided by way of example, the present invention should not be construed thereby. Rather, the present invention should be interpreted to include all modifications, variations, permutations, adaptations, aspects and embodiments that would incur to one skilled in this art who has been taught the present invention by way of the present application. Therefore, the present invention should be construed to be limited only by the following claims.

I claim:

1. A string board instrument having a main body and a removable neck section, said neck section comprising:

(a) a fretboard with at least one string and a bridge;

(b) pick-up means for detecting vibration of said at least one string and converting said vibration to an electrical signal;

(c) a headphone amplifier arranged to amplify said electrical signal; and, (d) a first electrical connector arranged to interface with a second electrical connector on said main body, wherein said first electrical connector is electrically connected to said headphone amplifier.

2. The instrument of claim 1, wherein said first electrical connector includes 9 pins.

3. The instrument of claim 2, wherein said headphone amplifier includes a headphone connector externally accessible to said neck section.

4. The instrument of claim 3, wherein said neck section further comprises a battery for providing power to said headphone amplifier, thereby rendering said neck section as a self contained operating entity when separate from said main body.

5. The instrument of claim 4, wherein said neck section further comprises a mechanical connection for a guitar strap.

6. The instrument of claim 5, wherein said neck section comprises means for activating and deactivating said headphone amplifier when said neck section is connected to said main body.

7. The instrument of claim 6, wherein said headphone amplifier comprises means for controlling volume of sound.

8. The instrument of claim 7, the neck section further comprises a plurality of tuning pegs arranged at an opposite end of said neck section from said bridge.

9. A string board instrument having a removable neck section with a first self contained amplifier, and a main body, said main body comprising:

(a) electronic pick-up means for receiving signals indicative of sound;

(b) a second self-contained amplifier arranged to amplify signals from said electronic pick up means;

(c) a speaker connected to an output of said second self-contained amplifier; and, (d) an electrical connector arranged to interface with a corresponding electrical connector on said removable neck section, wherein said electrical connector is electrically connected to said speaker and said corresponding electrical connector is electrically connected to said electronic pick up means.

10. The instrument of claim 9, wherein said electronic pick up means further comprise means for connecting to a plurality of electronic devices from a group consisting of a tape player, a CD player, a microphone and an output of an electronic musical instrument.

11. The instrument of claim 10, wherein said main body further comprises a battery arranged to power said self-contained amplifier thereby permitting operation of said instrument as a self contained unit.

12. The instrument of claim 11, wherein said main body is arranged to accommodate a plurality of different neck sections.

13. The instrument of claim 12, wherein said main body further comprises a connection to an external amplifier.

* * * * *